US005782539A

United States Patent [19]

Peterson

[11] Patent Number: 5,782,539

[45] Date of Patent: Jul. 21, 1998

[54] WALL-TO-WALL SURFACE MINING PROCESS

[76] Inventor: Randall D. Peterson, 175 S. Main St., 10th Floor Walker Bldg., Salt Lake City, Utah 84111

[21] Appl. No.: 558,826

[22] Filed: Nov. 16, 1995

[51] Int. Cl.[6] ..... E21C 41/00

[52] U.S. Cl. ..... 299/11; 299/19

[58] Field of Search ..... 299/10, 11, 19

[56] References Cited

U.S. PATENT DOCUMENTS 4,017,122 4/1977 Simpson ..... 299/19

FOREIGN PATENT DOCUMENTS 975388 9/1975 Canada ..... 299/19

2511416 9/1975 Germany ..... 299/19

*Primary Examiner*—David J. Bagnell

*Attorney, Agent, or Firm*—Conrad B. Houser

[57] ABSTRACT

A mining process that consists of a combination of surface mining and underground mining techniques carried out in a novel extraction sequence. The coal seam is first mined by surface-mining stripping methods to produce a highwall. Roadways to a predetermined distance underground from the surface highwall are then developed using continuous mining equipment, so that a panel of coal with a minable underground face or wall is blocked out. A longwall is then set up at the face and the panel is mined in retreat toward the surface highwall to a safety barrier determined by the highwall slope. Adjacent panels are successively developed and extracted by longwall mining, thereby permitting the recovery of substantially all coal reserves between the surface highwall and the predetermined distance at which the underground wall was set up.

3 Claims, 7 Drawing Sheets

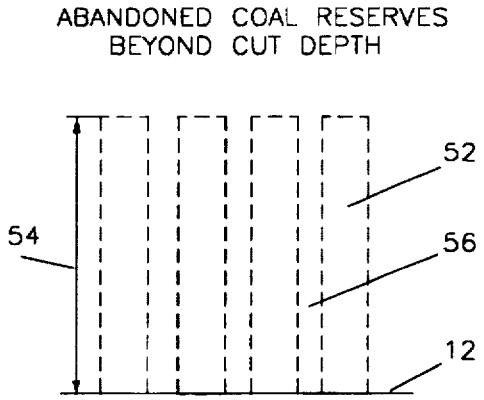
FIGURE 5A
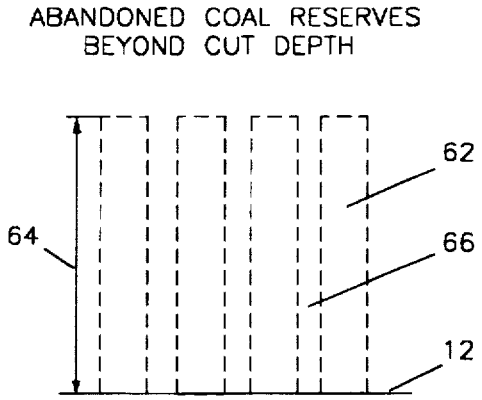
FIGURE 5B
FIG. 5

WALL-TO-WALL SURFACE MINING PROCESS

BACKGROUND OF THE INVENTION

1. Field of the Invention

This invention pertains in general to the field of surface mining and, in particular, to a novel adaptation of underground longwall techniques to recover surface-mine highwall reserves.

2. Description of the Related Art

Surface mining has been historically employed in the recovery of all types of minerals, including coal, copper, iron and aluminum ores, gold and tin from placers, and clays, gypsum, phosphate rock, sand, gravel and stone from pits and quarries. The method of this invention is applicable to strata-bound deposits, such as those found with sedimentary or evaporite-type minerals where the overburden is stripped to access them. These include deposits such as coal, lignite, oil shale, limestone, anthracite, trona, potash, halite, bauxite, gypsum, and other sedimentary rocks which host oxide, sulfide or carbonaceous gold ores and other poly-metallic minerals. The invention is generally applicable to mining operations that have substantially reached their economic stripping ratio.

In particular, the invention is directed at coal surface mining, where a coal seam is recovered by first stripping the overburden laying over it. The removal of the overburden to gain access to the coal reserves and reclamation of the surface after mining (that is, restoration of surface contours and drainage, and revegetation) are the major cost components of coal surface-mining operations. Therefore, the layout of a mine and its continued operation is based not only on the existence of coal reserves, but also on the economics of stripping the overburden from the formation (normally referred to in the industry as the economic stripping ratio or clean coal ratio) and of reclaiming the spoil (i.e., the mined overburden).

The removal of the overburden and coal is accomplished with drilling and blasting operations followed by excavating machines, such as backhoes, shovels, loaders, dozers, scrapers and draglines operating from or adjacent to the bench or the surface being excavated. As a result of this operation, the overburden or spoil is placed over mined areas beside the pit exposing the coal seam to be mined. The coal reserve is thus produced by progressively uncovering and mining the coal seam by the systematic removal of the overburden over the coal field until the operation becomes uneconomical. This process is generally referred to as strip mining because the overburden is removed in strips within the functional reaches of the excavating equipment. Since the removal of the overburden and reclamation represent the greatest unit costs of production, its depth and geologic features are critical to the economics of a mine. Hence, the exploitation of a coal deposit by surface mining is typically carried out until the coal seam becomes too deep for an economic stripping ratio.

When the final surface-mining cut has been made in an open-pit coal mine, the unmined coal seam remains exposed along the highwall (the slope of the unmined coal and overburden directly above the bench of the mine where the overburden has reached an uneconomic stripping ratio). Portions of this coal are usually recovered by secondary recovery methods, such as by remote-controlled continuous mining machines and horizontal auger drills (known in the art as punch mining). When the open-cut recovery limit is reached, augering is normally done by drilling single holes less than the full height of the coal seam to a depth determined by the dip and roll of the seam. Since these mining methods do not utilize roof supports, they are limited by the rock strength of the overlying strata and are thus restricted to penetration and retrieval of the coal from the surface. Accordingly, these methods must limit extraction to a level that ensures that the remaining coal continues to support the overburden strata and allows routine retrieval of the mining equipment. Highwall mining, auger mining, and punch mining methods are therefore typically limited to distances of about 200 to 1,000 feet from the highwall, with the longer penetration leaving wider pillars for support. The coal reserves beyond that limit have been available only by developing a separate underground operation.

In addition to their depth limitations, highwall and punch mining methods are also inherently hazardous. The roof and rib of the openings tend to fail in spite of efforts to design entry and pillar dimensions for optimal roof support. This condition becomes a hazard as people enter the opening to retrieve mining equipment. The failure is generally due to the absence of secondary support devices such as roof bolts or supporting props (generally installed with human labor in underground mines). Thus, unexpected roof falls occur as the result of either weak roof rock or excessive mining. When ground failure traps highwall mining equipment, it becomes necessary for people to enter the underground opening, install supporting devices and remove the equipment from the failed ground, all of which entails great risk to the people and additional expense to the operation. Moreover, highwall mining machines normally do not have means for ventilating the mining area and removing explosive concentrations of methane and other mine gases and coal dust. This condition has resulted in several fatalities related to the ignition of methane from auger mining.

Therefore, there is a need for a safer, more efficient and more complete method of recovery of highwall coal reserves as a surface-mine operation.

BRIEF SUMMARY OF THE INVENTION

The primary goal of this invention is a method of coal production that permits the economic recovery of coal reserves behind the highwall of a surface mine after the economic stripping ratio has been reached.

Another important objective is a method of mining that combines underground-mining technology with the advantages of a surface mine operation.

Yet another goal is a method of mining underground coal that does not require the conventional outby support infrastructure of underground operations.

Finally, another objective of the invention is a mining technique that is compatible with and suitable for direct implementation with prior-art mining methods and equipment.

Therefore, according to these and other objectives, the present invention consists of a combination of surface mining and underground mining techniques carried out in a novel extraction sequence. The coal seam is first mined by surface-mining stripping methods to produce a highwall. Roadways to a predetermined distance underground from the surface highwall are then developed using underground room-and-pillar mining methods, so that a panel of coal with a minable underground face or wall is blocked out. Longwall mining equipment is then set up at the face and the panel is mined in retreat toward the surface highwall to within a safety-barrier distance from the highwall slope. Adjacent panels are successively developed and extracted by longwall mining, thereby permitting the recovery of substantially all coal reserves between the surface highwall and the predetermined distance at which the underground wall was set up.

Various other purposes and advantages of the invention will become clear from its description in the specification that follows. Therefore, to the accomplishment of the objectives described above, this invention consists of the features hereinafter illustrated in the drawings and fully described in the detailed description of the preferred embodiment and particularly pointed out in the claims. However, such drawings and description disclose but some of the various ways in which the invention may be practiced.

BRIEF DESCRIPTION OF THE DRAWINGS

FIGS. 5A and 5B are simplified maps of the highwall area showing extraction after mining operations according to the methods of FIGS. 3 and 4, respectively.

DESCRIPTION OF THE PREFERRED EMBODIMENTS OF THE INVENTION

Figure 1:
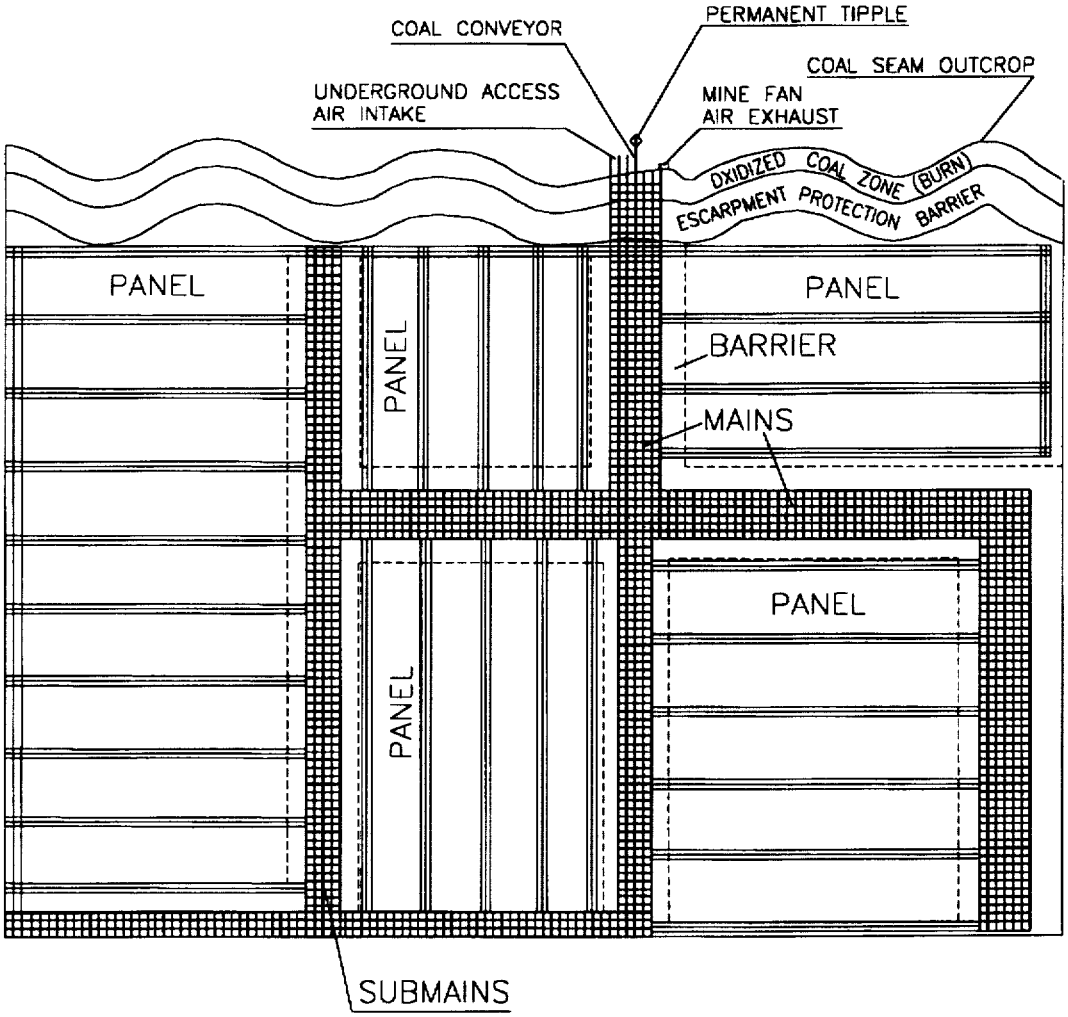
FIG. 1 is a schematic representation of a typical underground coal mine as it is being developed according to prior-art mining procedures.

The heart of this invention lies in the recognition that modern longwall underground coal-mining techniques can successfully be adapted to markedly improve the recovery of highwall coal reserves left over from conventional surface mining. As illustrated schematically in the typical mining plan of FIG. 1, traditional underground mining by longwall is founded on the well-established procedure of designing a mining plan based on main roadways or entries leading (usually) to submain entries and then to longwall sections where the coal is produced. Mains and submains are necessary in underground mining to optimize the exploitation of the reserve from a centrally located shaft and to bypass the portion of the seam near the outcrop consisting of oxidized, noncommercial coal and weathered roof with poor mining conditions. Mains are necessary in underground mines because they provide the infrastructure from which panels can be developed and from which the mine workings can be extended. Each mining section is supported by outby manpower and equipment located in submain and main entries, which are utilized for providing air ventilation throughout the mine, for material haulage to and from the longwall sections, for water and power systems, and for access to the producing faces.

In contrast to room-and-pillar mining, where pillars of coal may be left in place to support the overlying rock strata, the extraction of coal panels by longwall mining is necessarily followed by the collapse of the rock strata above the mined coal seam, thereby forming an underground rubble cave behind the producing face. As well understood in the art, this cave will progress upward until the swell from the rubbled material together with the subsided overburden has substantially filled the void resulting from coal extraction. The systematic caving and surface subsidence are characteristics of full-extraction longwall mining. Surface mines, on the other hand, are planned and regulated by mining laws around the notion of removing the overburden prior to coal extraction and replacing it in the mine pit as part of the mining process and the reclamation of the surface after mining has been exhausted. Therefore, the subsidence or total collapse of the surface that would follow the mining of the highwall by longwall techniques would be a normal and acceptable consequence of extending the operation of a longwall to a surface mine.

Referring now to the drawings, wherein like numerals and symbols designate like parts and features throughout, the present invention requires and includes the normal development of a coal surface mine to the stage where the economic stripping ratio has been reached and a highwall is exposed. Typically, as illustrated in the schematic cross-section of FIG. 2, a coal seam 10 is exposed along the bottom of a highwall 12 at a boundary with the strip floor 14 of the open pit 16 of a surface mine 100. The pit 16 is typically mostly covered by spoil piles 18, which consist of the mined overburden 20 previously removed by draglines or other types of excavating machines to gain access to the coal seam 10 and then placed back to fill the pit 16, after removal of exposed portions of the coal seam 10, in order to minimize environmental disturbance and facilitate reclamation of the surface 22.

Figure 3:
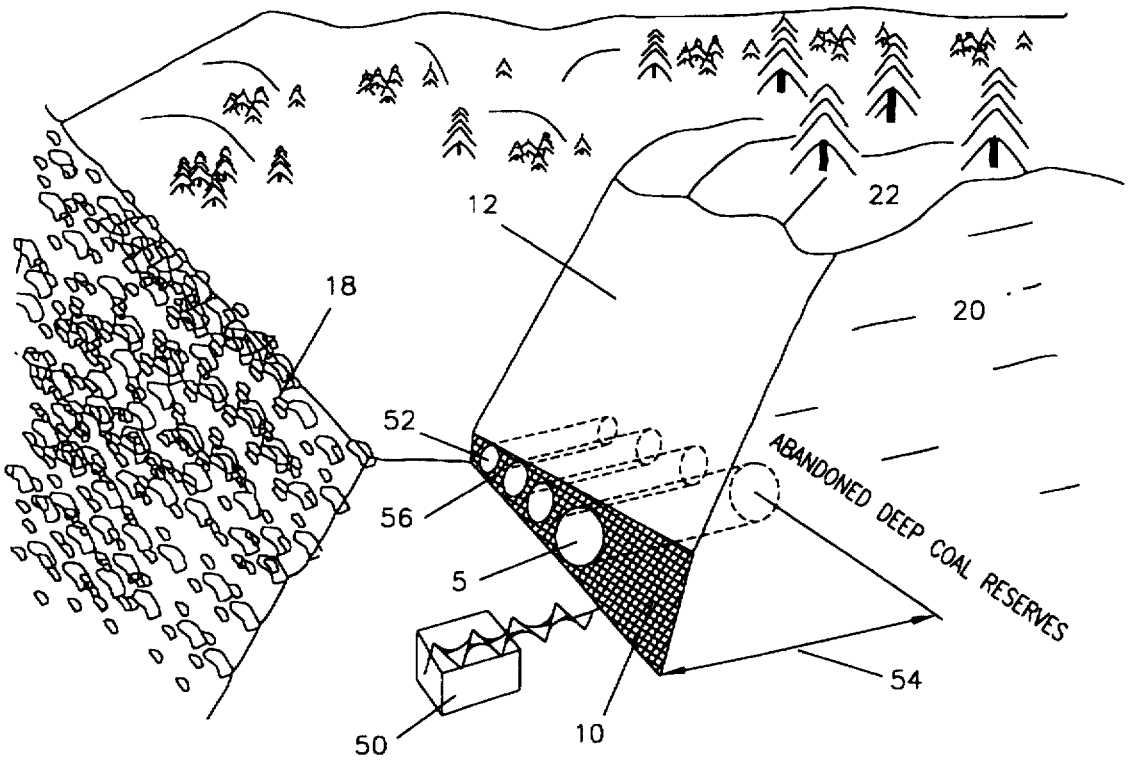
FIG. 3 is a schematic perspective representation of a conventional highwall mining operation using remote-controlled auger drilling equipment.

FIG. 3 is a schematic representation of a highwall mining operation using traditional remote-controlled auger drilling equipment. An auger machine 50 is operated by remote control to drive substantially-parallel circular tunnels 52 in the coal seam 10. Each tunnel 52 is driven continuously starting from the highwall 12 and ending at a maximum-cut depth 54, leaving support pillars or webs 56 between tunnels. Because of the limited distance suitable for mining by remote-controlled auger machines, much of the reserves are abandoned as deep coal unaccessible by surface mining techniques.

Figure 4:
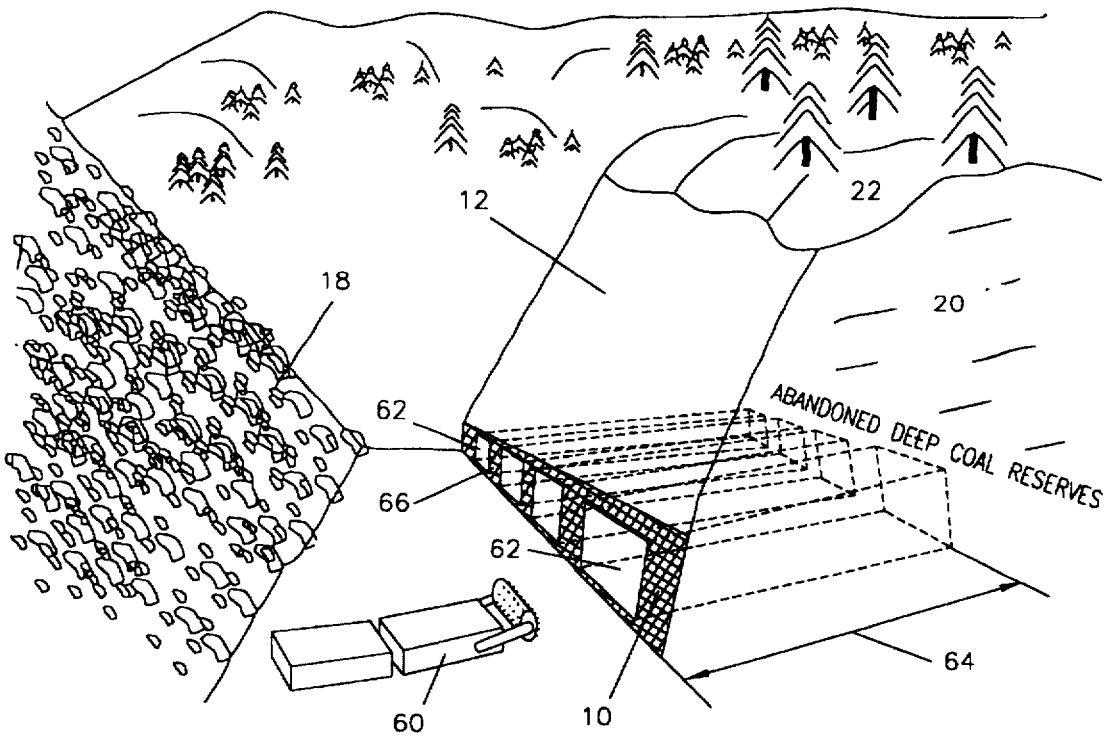
FIG. 4 is a schematic perspective representation of a conventional highwall mining operation using remote-controlled continuous miners.

Similarly, FIG. 4 is a schematic representation of a highwall mining operation using traditional remote-controlled continuous miners. A highwall miner with a continuous haulage unit 60 is operated by remote control to drive substantially-parallel rectangular tunnels 62 in the coal seam 10. Each tunnel 62 is driven continuously starting from the highwall 12 and ending at a maximum-cut depth 64, leaving support pillars or webs 66 between tunnels. Again, because of the limited distance suitable for mining by remote-controlled machines, much of the reserves are abandoned as deep coal unaccessible by surface mining techniques. No cross-cuts between tunnels are typically driven as well, thereby further reducing recovery. FIGS. 5A and 5B are mine-map representations showing the areas of coal extraction after mining by auger machines and continuous miners, respectively. In both cases, the recovery is limited to the volume of the tunnels illustrated in the figures.

Figure 2:
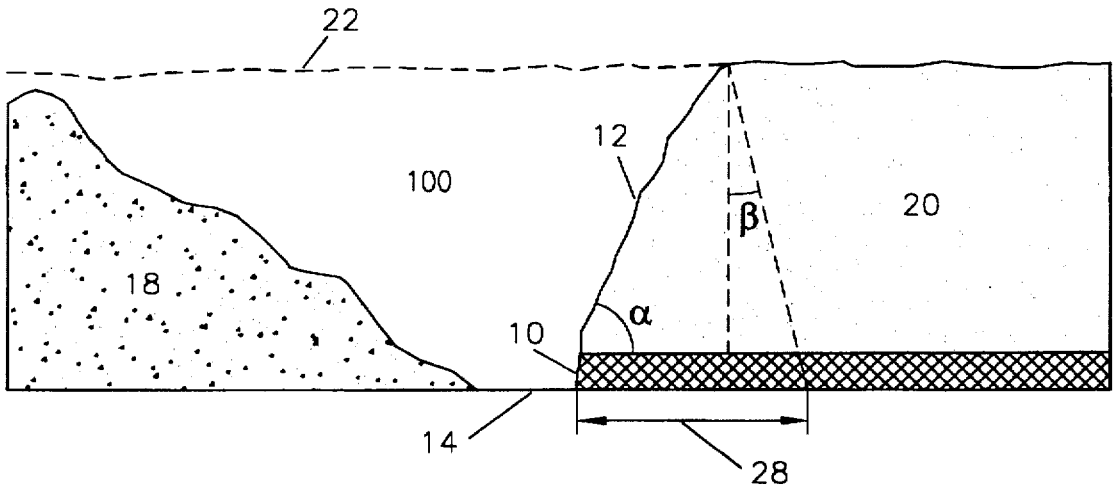
FIG. 2 is a schematic cross-section of a typical coal surface mine illustrating a highwall after all coal economically recoverable by surface-mining techniques has been removed.
Figure 6:
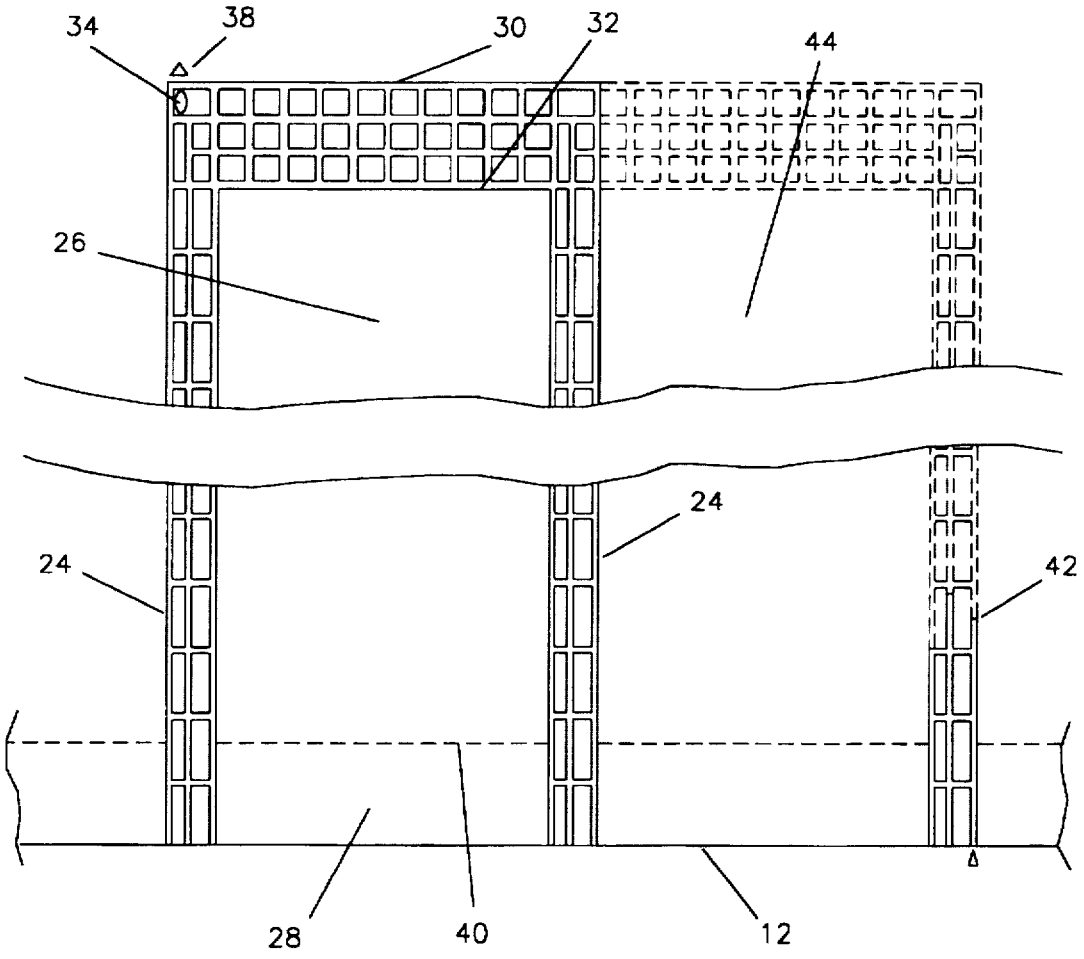
FIG. 6 is a schematic representation of the surface mining technique of the invention utilizing a longwall to extract surface-mine highwall reserves.

Referring to FIG. 6, a schematic representation of the surface mining technique of the invention is illustrated. After the economic stripping ratio is reached by conventional strip mining, substantially parallel sets of roadways 24 are developed in the coal seam from the highwall 12 to a predetermined distance approximately equal to the planned length of a longwall panel 26 and including a safety barrier 28 from the highwall. As illustrated in FIG. 2, a minimum barrier determined by the highwall slope α and the angle of draw β (the minimum underground angle from the crest edge of the highwall beyond which progression of the longwall face will cause the surface of the mine to subside and potentially disturb the highwall slope) is necessary to maintain the integrity of the surface 22 while mining the panel 26. The angle of draw is a function of the specific geotechnical characteristics of the overburden rock. Connecting entries 30 are then developed to establish a longwall mining face or wall 32, where the longwall equipment is set up to extract the portion of the coal seam 10 in the panel 26. Mine ventilation is provided by an exhausting fan 34 operating on a ventilation raise 36 reaching the connecting entries 30 from the surface 22 above the mine. The longwall mining operation is conducted according to conventional underground panel-extraction techniques whereby, referring to FIG. 6, the coal in panel 26 is mined out to the barrier boundary 40 and the overlying strata are allowed to collapse behind the wall as it advances during mining. Contemporaneously (preferably), new sets of entries 42 in the coal seam 10 are driven from the longwall 12 to develop another panel 44 (shown partially in dashed lines) for extraction by longwall mining.

Figure 7:
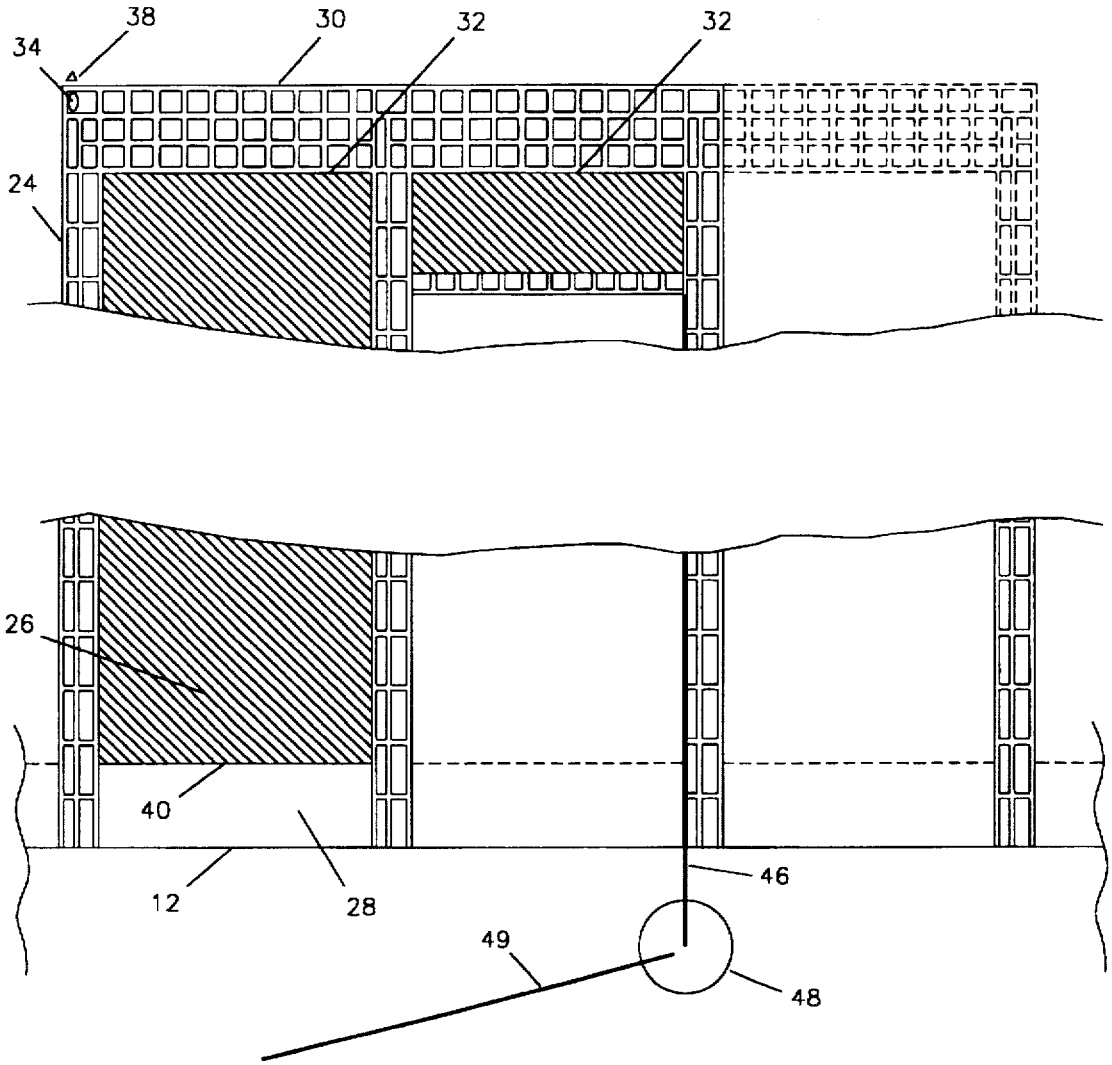
FIG. 7 is a mine map showing the development and mining progression of the mine of FIG. 6.

As those skilled in the art understand, each set of roadways or entries 24 and 42 (also called gate roads with reference to the head and tail gates of a longwall face) may consist of two or more entries (one may be used if mining in advance, but would be uneconomical for highwall mining), depending on the geologic characteristics of the overburden 20 and the corresponding technical and legal requirements for ventilation and safe operation during the development and panel-extraction phases of operation. The roadways are preferably developed using room-and-pillar mining methods with continuous miners, as customary in underground mines, and the same procedures and safeguards for ventilation, material removal and escape routes can be adopted in connection with the wall-to-wall mining technique of the invention. As seen in FIG. 7, the coal seam 10 can be extracted (shown by cross-hatching) along the entire highwall 12 in successive panels mined from a sequence of interior walls 32 where the longwall is set up and advanced toward the highwall 12 to the boundary 40 of the safety barrier 28. Conventional belt conveyors 46 and a transfer point 48 (or a coal pile) set up in the gate roads of each longwall panel can be utilized to transport the coal to the surface through a land conveyor 49. The only coal left after extraction of all panels is in the safety barrier 28 and in the pillars supporting the gate roads.

The wall-to-wall method of the invention is fundamentally different from either conventional underground or conventional surface mining methods. In the case of underground mining, a fundamental difference between the present invention and conventional retreating longwall mining is that the wall-to-wall method completely eliminates the need for main and submain entries, barriers to protect them, and ancillary haulage to transport the coal from the panel to the surface. This considerably reduces development capital expenses and operating costs, rendering highwall-coal recovery much more economical than by traditional underground mining methods.

Another unique aspect of the invention is its simplicity in ventilation. With the wall-to-wall method, the ventilation system is greatly simplified by the lack of mains and submains connecting adjacent panels. Thus, while in traditional underground mining contaminants introduced to the airways in the mains and submains connecting multiple panels can contaminate the air from one panel to another, in wall-to-wall mining such contamination is not possible because each panel has its own independent fresh air source. Hence, mine fires or explosions occurring in one panel are isolated from the rest of the mine due to the physical separation of working sections with unmined blocks and each section having a separate, independent ventilation system. In addition, because of the temporary nature of the ventilation system set up for each longwall panel, portable fans and equipment can be used with great savings and flexibility.

Another unique aspect of the invention is the shorter travel distance required to reach the working area of the mine (sometimes referred to as the working face or the working place). Due to the direct panel access from the surface highwall, the time spent traveling underground to and from the working place by mine workers is greatly reduced in comparison to traditional underground mines.

Another unique aspect of the invention is its superior geotechnical ground-control requirements. Because panels are abandoned as soon as they have been fully extracted, they must only remain stable for a short time. Wall-to-wall gate roads, for example, would only be required to stay open while they are in use during development and during retreat (but only to the longwall face). This is unlike the mains and submains in a traditional underground mine which must remain open for the life of the mine (more than 100 years in some cases). The time-related effects of mining-induced ground stresses and strains continually deteriorate the roof and floor in traditional mains and submains and require ongoing maintenance of their structural integrity with the continual installation of additional roof support. This is especially true where the roof rock is of a plastic nature susceptible to oxidation or weathering.

Another unique aspect of the invention is its superior haulage characteristics. The wall-to-wall method conveys coal, loaded at the longwall face by the stage loader onto the panel belt, directly to the surface thereby eliminating redundant conveyor haulage. Direct access to reserves from panels driven and retreated perpendicularly to the highwall is the primary reason that mains are unnecessary with the method of the invention. Thus, the invention is particularly suited for long extensions of the developing longwall panel belt, allowing the method's application for extracting reserves extending well beyond one mile from the highwall. This permits exploitation of the entire contiguous resource from adjacent locations along the same highwall. The feature is made possible by the use of booster/tripper drives with load sharing capabilities placed at intermediate points along the longwall panel belt to distribute motive power and belt tension along the length of the belt. Hence, the same belt can be extended without limit by simply adding and linking more booster drives to the system. Prior to the use of these load distributing belt drives, the ultimate length of a conveyor was limited by the tensile strength of the belting material subjected to the tension placed on it at a single drive location.

The wall-to-wall methods of the invention is also distinct from traditional surface mining methods. Truck loading and hauling are characteristics of surface mining where material is mined and loaded from multiple pits simultaneously. The wall-to-wall method eliminates the need for mobile surface haulage equipment because it is capable of producing large quantities of coal from central highwall locations, which are stationary points for extended period of time (typically 1 to 2 years). From these central points all production can be gathered and conveyed with extendible overland conveyors, thereby eliminating the need for truck haulage when it is cost effective to do so. This offers the advantage of being able to haul coal with low-cost overland conveying equipment and further eliminates the need for trucks and loading equipment, haulroads, berms and truck loading areas. This feature, along with the elimination of spoil pile reclamation, further distinguishes the method as unique and different from traditional surface mining methods.

Thus, the mining method of the present invention provides many advantages for mining highwall coal with respect to the heretofore-practiced alternative of developing a separate underground mine to reach these reserves. The mine development is greatly reduced, leading to more rapid longwall production and a correspondingly lower overall cost of extraction. No mine infrastructure is required to support the longwall panel; therefore, mainline coal haulage, electrical distribution, water distribution, mine communications/monitoring, and roof-support systems are all drastically reduced. The ventilation system is greatly simplified and compatible with use of portable equipment. The coal haulage system is greatly simplified by the elimination of transfer points between mains, submains and gate ways, and, through the use of booster/tripper drives with load sharing equipment, it is possible to extend the length of panel belts to the boundary of the reserve. The absence of main and submain entries also eliminates the need for underground electrical power centers, such as switch gear and distribution equipment, and make it possible to provide power from a portable substation located on the surface. Similarly, no continuous rock dusting of mains, submains and inactive mine sections is required to suppress mine dust, thereby also reducing the necessity for patrolling and monitoring belt lines. As one skilled in the art would readily understand, these advantages constitute a substantial improvement over, and represent an exciting alternative to, the highwall mining methods used in the art.

Various changes in the details, steps and components that have been described may be made by those skilled in the art within the principles and scope of the invention herein illustrated. For example, it is clear that the concepts of the invention can be applied to any mining situation where a mineral deposit is embedded between strata at a depth suitable for initial extraction by surface-mining methods to produce an exposed highwall. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope embraced by any and all equivalent processes and products.

I claim:

1. A process for mining a seam of coal from an underground reserve having an overburden partially suitable for strip mining, comprising the following steps:

(a) stripping said overburden and mining said coal utilizing surface-mine extraction methods until an economic stripping ratio is reached, thereby producing a highwall containing an exposed face of said coal seam;

(b) starting at said exposed face, developing two substantially parallel sets of gate entries in the coals seam to a predetermined distal distance from the highwall;

(c) connecting said two substantially parallel sets of gate entries approximately at said distance from the highwall, thereby defining a coal panel and establishing a distal mining face for longwall operation; and (d) starting at said distal mining face, mining said coal panel in retreat using longwall mining methods to a predetermined proximal distance from said highwall to provide a safety barrier between the highwall and the coal panel.

2. The process of claim 1 further comprising the steps of developing additional substantially parallel sets of gate entries in the coal seam, starting at the exposed face, to additional predetermined distal distances from the highwall; and of connecting said additional substantially parallel sets of gate entries approximately at said additional predetermined distal distances from the highwall, thereby defining additional coal panels and establishing additional distal mining faces for sequential panel extraction by longwall operation.

3. The process of claim 2 wherein the development of gate entries and their connections are carried out using continuous mining methods.

* * * * *